US006711366B2

(12) United States Patent
Beaufort

(10) Patent No.: US 6,711,366 B2
(45) Date of Patent: Mar. 23, 2004

(54) RESIDUAL TONER MANAGEMENT IN AN ELECTROPHOTOGRAPHIC DEVICE

(75) Inventor: Richard F. Beaufort, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/195,100

(22) Filed: Jul. 15, 2002

(65) Prior Publication Data

US 2004/0009009 A1 Jan. 15, 2004

(51) Int. Cl.[7] ..... G03G 21/10

(52) U.S. Cl. ..... 399/120; 399/297; 399/358; 399/359

(58) Field of Search ..... 399/101, 297, 399/302, 358, 359, 360, 120

(56) References Cited

U.S. PATENT DOCUMENTS 5,442,430 A * 8/1995 Ishii et al. ..... 399/359 X

* cited by examiner

*Primary Examiner*—William J. Royer

(57) ABSTRACT

A component for an electrophotographic device having an intermediate transfer device includes a hopper configured for association with a toner cartridge. The hopper is configured to store residual toner collected from the intermediate transfer device. The hopper includes an opening configured to receive the residual toner.

20 Claims, 5 Drawing Sheets

RESIDUAL TONER MANAGEMENT IN AN ELECTROPHOTOGRAPHIC DEVICE

BACKGROUND

It is generally known that electrophotographic devices (e.g., printers, copiers utilize toner to generate text and/or images on a print medium (e.g., paper, transparency media). In this regard, a toner cartridge typically stores the toner and an optical photoreceptor ("OPR") is utilized to collect toner from the toner cartridge. As described in greater detail below, In a class of electrophotographic devices the toner is transferred from the OPR to an intermediate transfer device ("ITD") and then transferred to the print medium.

In one class of electrophotographic device, an ITD, such as, an intermediate transfer cylinder ("ITC"), an Intermediate transfer belt ("ITB") or the like, is utilized to collect toner from the OPR. Following the transfer to the OPR, a scraping device is generally utilized to remove any remaining toner from the OPR. This "residual toner" generally accumulates on the leading edge of the scraping device. As additional residual toner is accumulated on the leading edge of the scraping device, this newly collected residual toner may push the previously collected residual toner into a slot. The slot generally serves as an opening for a receptacle (e.g., hopper, container, bin) where the residual toner is stored. The receptacle is typically about as wide as the toner cartridge.

Furthermore, the ITD may be configured to apply the toner to the print medium. While a majority of the toner may be transferred to the print medium, some toner may remain on the ITO. To substantially prevent the remaining toner from adversely affecting the image quality of subsequent printed content (e.g., text, images), a scraping or brushing mechanism is typically employed to essentially clean the ITD following the transfer of the toner to the print medium.

This remaining (i.e., residual) toner is typically deposited in a bin. The bin is typically either a user serviceable component or of sufficient capacity to collect residual toner for the expected life of the electrophotographic device. In this regard, a user serviceable bin may represent yet another component the user may have to purchase and/or attend to. This may increase user frustration particularly if the bin servicing procedure is messy. Alternatively, if the bin is large enough to collect residual toner over the expected life of the electrophotographic device, the size of the electrophotographic device may be inconveniently large.

SUMMARY

In accordance with an embodiment, the invention pertains to a component for an electrophotographic device having an intermediate transfer device. This component includes a hopper configured for association with a toner cartridge. The hopper is configured to store residual toner collected from the intermediate transfer device. The hopper includes an opening configured to receive the residual toner.

BRIEF DESCRIPTION OF THE DRAWINGS

Embodiments of the invention are illustrated by way of example and not limitation in the accompanying figures in which like reference numerals refer to like elements, and wherein.

DETAILED DESCRIPTION

Figure 1:
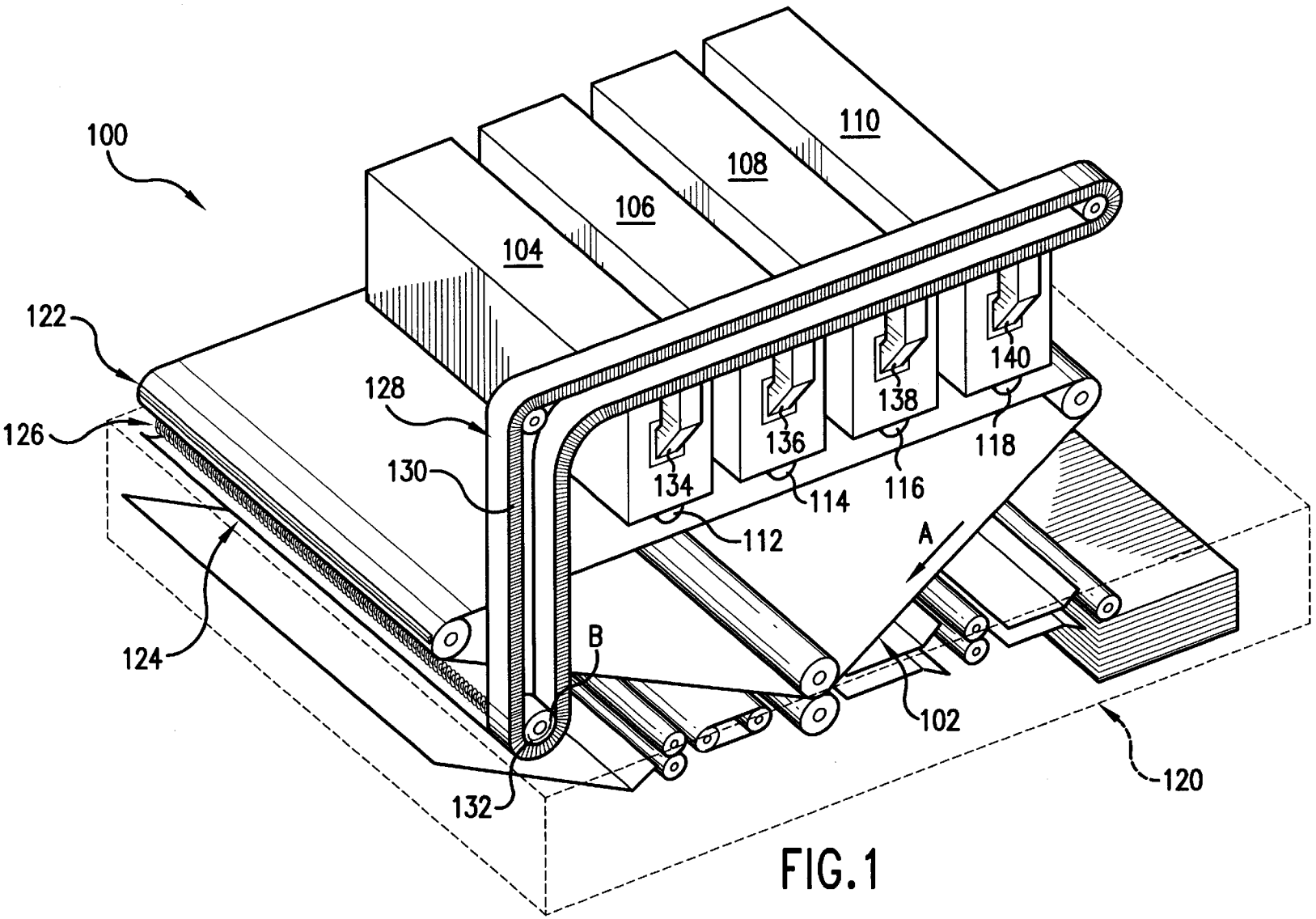
FIG. 1 is a simplified perspective view of an electrophotographic printing device according to an embodiment of the invention.

For simplicity and illustrative purposes, principles of the invention are described by referring mainly to embodiments thereof. In the following description, numerous specific details are set forth in order to provide a thorough understanding of the invention. It will be apparent however, to one of ordinary skill in the art, that the invention may be practiced without limitation to these specific details. In other instances, well known methods and structures have not been described in detail so as not to unnecessarily obscure the invention. In addition, although FIG. 1 depicts four toner cartridges, it is to be understood that the invention is not limited to four toner cartridges, but rather, the invention may include any reasonable number of toner cartridges. In one respect, the number of toner cartridges may correspond to the number of toner colors within the electrophotographic printing device. Accordingly, the four toner cartridges depicted in FIG. 1 are for illustrative purposes only and thus is not meant to limit the invention in any respect.

Figure 2A:
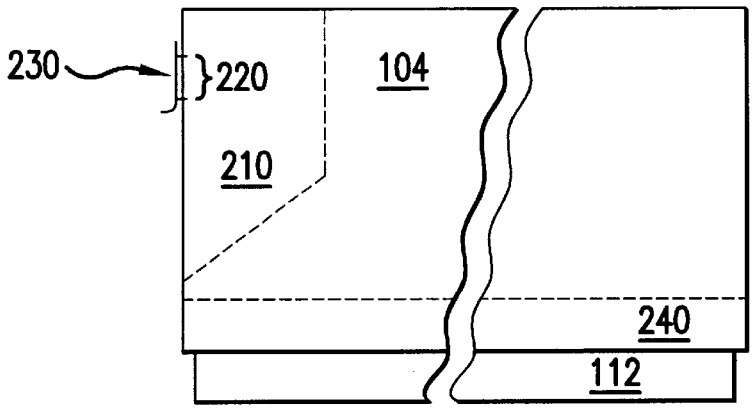
FIGS. 2A–2C are cross sectional views of toner cartridges according to various embodiments of the invention.
Figure 2B:
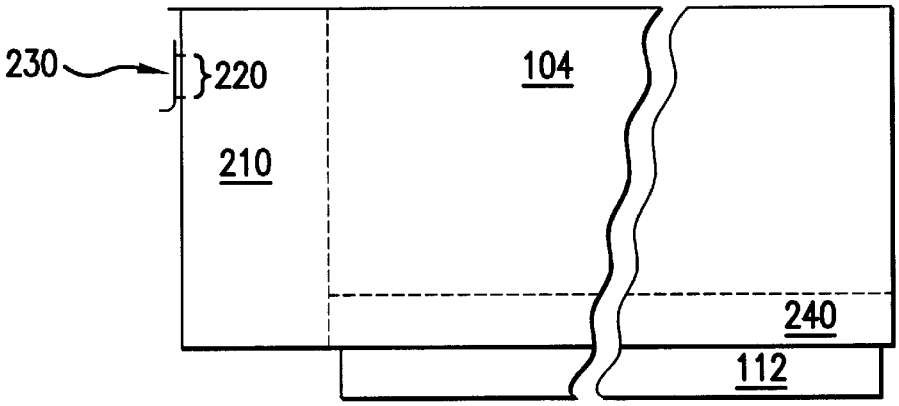
Figure 2C:
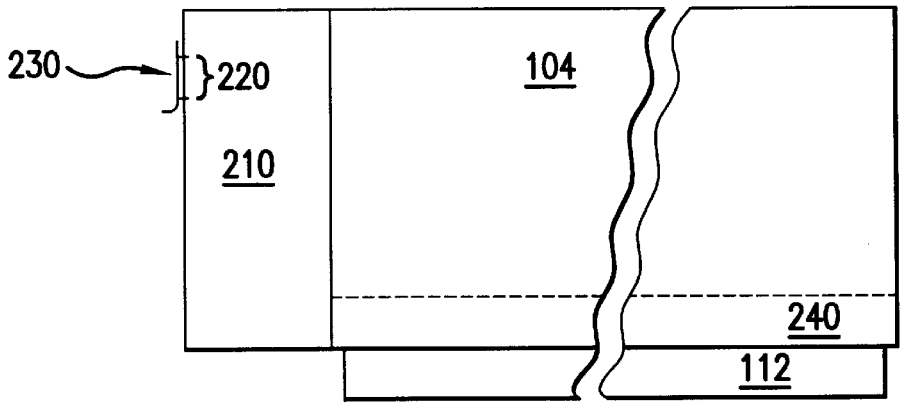

FIG. 1 is a simplified perspective view of an electrophotographic printing ("EP") device 100 according to an embodiment of the invention. The EP device 100 includes an intermediate transfer belt (ITB) 102, toner cartridges 104, 106, 108, 110, paper path 120, scraper 122, catch 124, auger 126 and manifold 128. The cross sectional views of several toner cartridges are shown in FIGS. 2A–2C. Additionally, each toner cartridge 104, 106, 108, 110 includes a respective optical photoreceptor (OPR) 112, 114, 116, 118 and the manifold 128 includes chutes 134, 136, 138, 140. Each chute 134, 1336, 138, 140 is configured to attach to an opening (see FIGS. 2A–2C) in a respective toner cartridge 104, 106, 108, 110.

The EP device 100 may be configured to print content (e.g., text, image) on to paper or other such print media. For example, the ITB 102 is driven by a motor (not shown) in direction A. As an area of the ITB 102 moves past the toner cartridge 104, a portion of print content may be transferred from the OPR 112 to the ITB 102 in a manner similar to known EP devices. As this area of the ITB 102 moves past successive toner cartridges 106, 108, 110, a remaining portion of the print content may be transferred from the OPR 114, 116, 118 as appropriate. In this manner, the print content may be transferred to the ITB 102. The print content may subsequently be transferred to the print media (not shown) as the print media travels through the paper path 120.

Following the transfer of the content to the print media, substantially all of the remaining toner (i.e., residual toner) may be removed from the ITB 102 by the scraper 122 or various other cleaning devices (e,g., a brush). The catch 124 Is positioned to catch the residual toner as it falls off the scraper 122 and an end of the catch 124 is configured for attachment to the manifold 128. The auger 126 may be a helical wire, positioned at or near the bottom of the inside of the catch 124. The auger 126 may be rotated by a motor (not shown) to convey the residual toner towards the manifold 128. Attentively, the auger 126 may be a screw and in various other embodiments, the auger 126 may be replaced with a variety of residual toner conveyance devices (e.g., a belt, air flow, vibrating a downward sloping surface etc,).

Residual toner Is conveyed by the auger 126 towards the manifold 128 and is deposited within the manifold 128. A conveyer belt 130 or other conveyance device may be positioned within the manifold 128 and configured to move residual toner. For example, the conveyer belt 130 may be driven by a motor (not shown) connected to a drive wheel 132. The drive wheel 132 is rotated in direction B and thus, the conveyer belt 130 is driven about within the manifold 128. As the conveyer belt 130 moves within the manifold 128, it picks up the residual toner deposited by the auger 126. The conveyer belt 130 moves the residual toner within the manifold 128 and, as the residual toner passes over the chutes 134, 136, 138, 140, residual toner may fall down the chutes 134, 136, 138, 140. For example, as residual toner passes over the chute 134, some portion of the residual toner may fall down the chute 134 and through an opening 220 (shown in FIG. 2A) and into a hopper 210 (shown in FIG. 2A) associated with the toner cartridge 104. In operation, if a hopper 210 (see FIGS. 2A–2C) becomes full, the respective chute 134, 136, 138, 140 may fill to a point in which little or no additional residual toner may accumulate. At which point the conveyer belt 130 may continue to move the residual toner within the manifold 128 until the residual toner passes over a chute 134, 136, 138, 140 and/or its respective hopper 210 (see FIGS. 2A–2C) that has additional capacity to receive residual toner.

FIGS. 2A–2C are cross sectional views of the toner cartridge 104 according to various embodiments of the invention. As shown in FIG. 1, the toner cartridge 104 is a component of the EP device 100. Alternatively, the toner cartridge 104 may be configured to be implemented in any reasonably suitable EP device. As shown in FIG. 2A, the toner cartridge 104 includes a hopper 210. The volume occupied by the hopper 210 may be formed by essentially replacing some portion of the volume of a conventional toner cartridge. In this manner, the toner cartridge 104 having the hopper 210 may have essentially the same dimensions as a conventional toner cartridge.

Additionally, the toner cartridge 104 includes an opening 220 configured to mate with a chute 134, 136, 138, 140 when the toner cartridge 104 is installed in a suitable EP device, such as EP devices 100 (FIG. 1), 400 (FIG. 4) and 500 (FIG. 6). Furthermore, the toner cartridge 104 includes a shutter 230 or other closure device configured to substantially seal residual toner within the hopper 210. The operation of the shutter 230 is shown in FIGS. 3A–3E. However, in general, the shutter 230 is configured to open as the toner cartridge 104 is Installed in the EP device 100, 400 or 500 and dose as the toner cartridge 104 Is removed.

The toner cartridge 104 further includes a receptacle 240 configured to store residual toner collected from the OPR 112.

FIG. 2B is a cross sectional view of the toner cartridge 104 according to another embodiment of the invention. The toner cartridge 104 of this embodiment is similar to the toner cartridge 104 described hereinabove and thus only those features which are reasonably necessary for a complete understanding of this embodiment are described hereinbelow. A difference from the toner cartridge 104 of FIG. 2A is that the volume of the hopper 210 is substantially added to the volume of a conventional toner cartridge.

FIG. 2C is a cross sectional view of the toner cartridge 104 according to another embodiment of the invention. The toner cartridge 104 of this embodiment is similar to the toner cartridge 104 described in FIG. 2B and thus only those features which are reasonably necessary for a complete understanding of this embodiment are described hereinbelow. A difference from the toner cartridge 104 of FIG. 2B is that the hopper 210 of this embodiment is configured to be added to an existing toner cartridge. For example, the hopper 210 may be initially constructed as a distinct device. In this manner, during or subsequent to construction, the hopper 210 may be fastened to the toner cartridge 104 in any reasonably suitable fastening manner (e.g., adhesive, mating connectors, mechanical fasteners).

Figure 3A:
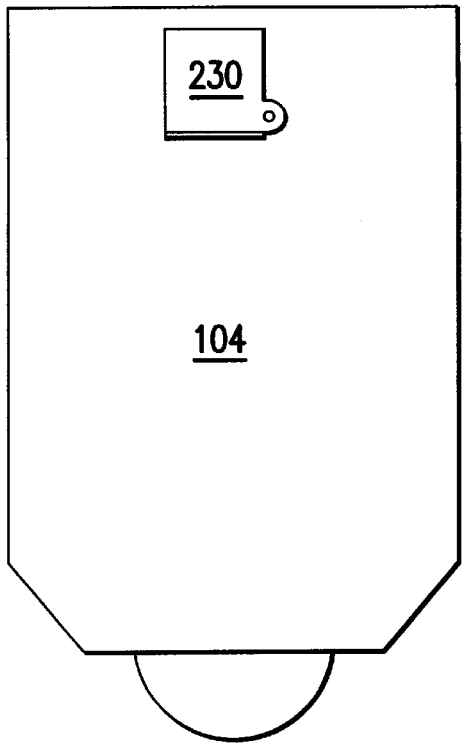
FIGS. 3A–3E are illustrations of various views of a shutter according to an embodiment of the invention.

FIGS. 3A–3E are illustrations of various views of the shutter 230 according to an embodiment of the invention. As shown in FIG. 3A, the toner cartridge 104 includes the shutter 230. The shutter 230 is depicted in a closed position. In this closed position, the shutter 230 is configured to substantially prevent residual toner, which may be present in the hopper 210, from spilling out of the opening 220 (opening 220 shown in FIG. 3B).

Figure 3B:
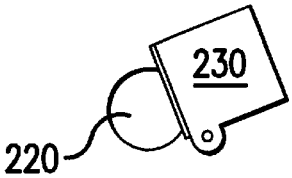

FIG. 3B is an illustration of the shutter 230 in an open position. In this open position, the shutter 230 is configured to allow residual toner to enter the hopper 210 through the opening 220.

Figure 3C:
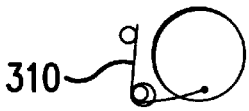

FIG. 3C is an illustration of the shutter 230 in the closed position from within the hopper 210. As shown by this view, a spring 310 is configured to provide sufficient force to substantially prevent the casual opening of the shutter 230.

Figure 3D:
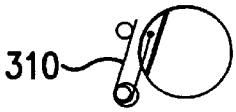

FIG. 3D is an illustration of the shutter 230 in the open position from within the hopper 210.

Figure 3E:
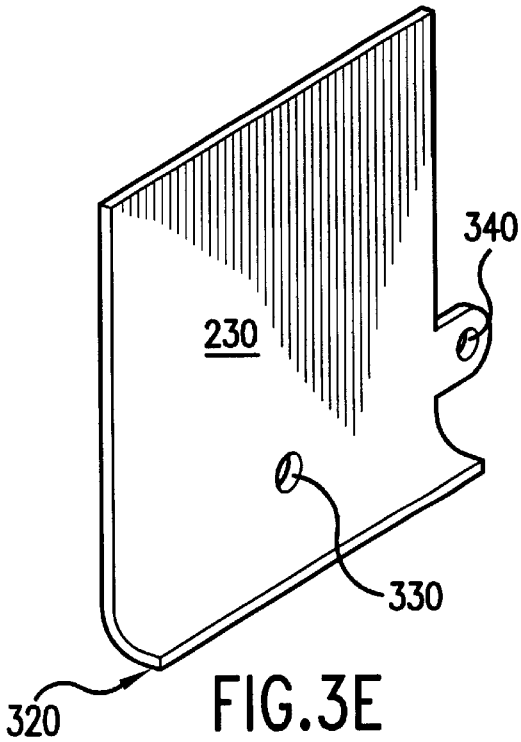

FIG. 3E is an illustration of the shutter 230. As shown in FIG. 3E, the shutter 230 includes a lip 320. The lip 320 may be configured to provide a bearing surface with which the shutter 230 may be opened as the toner cartridge 104 is installed within the EP device 100, 400 or 500. Additionally, the shutter 230 includes holes 330 and 340. The hole 330 may be configured to accept one end of the spring 310. The hole 340 may be configured for attachment to a post (not shown) on the toner cartridge 104. In this manner, the hole 340 may provide a pivot point for the shutter 230.

It is to be understood that the shutter 230 depicted above is for illustrative purposes only and not meant to limit the scope of the invention. In this regard, any reasonable device operable to substantially seal residual toner within the hopper 210 when the toner cartridge 104 is removed from the EP device 100, 400 or 500 and operable to allow residual toner to enter the hopper 210 when the toner cartridge 104 is installed in the EP device 100, 400 or 500 may be substituted for the shutter 230.

Figure 4:
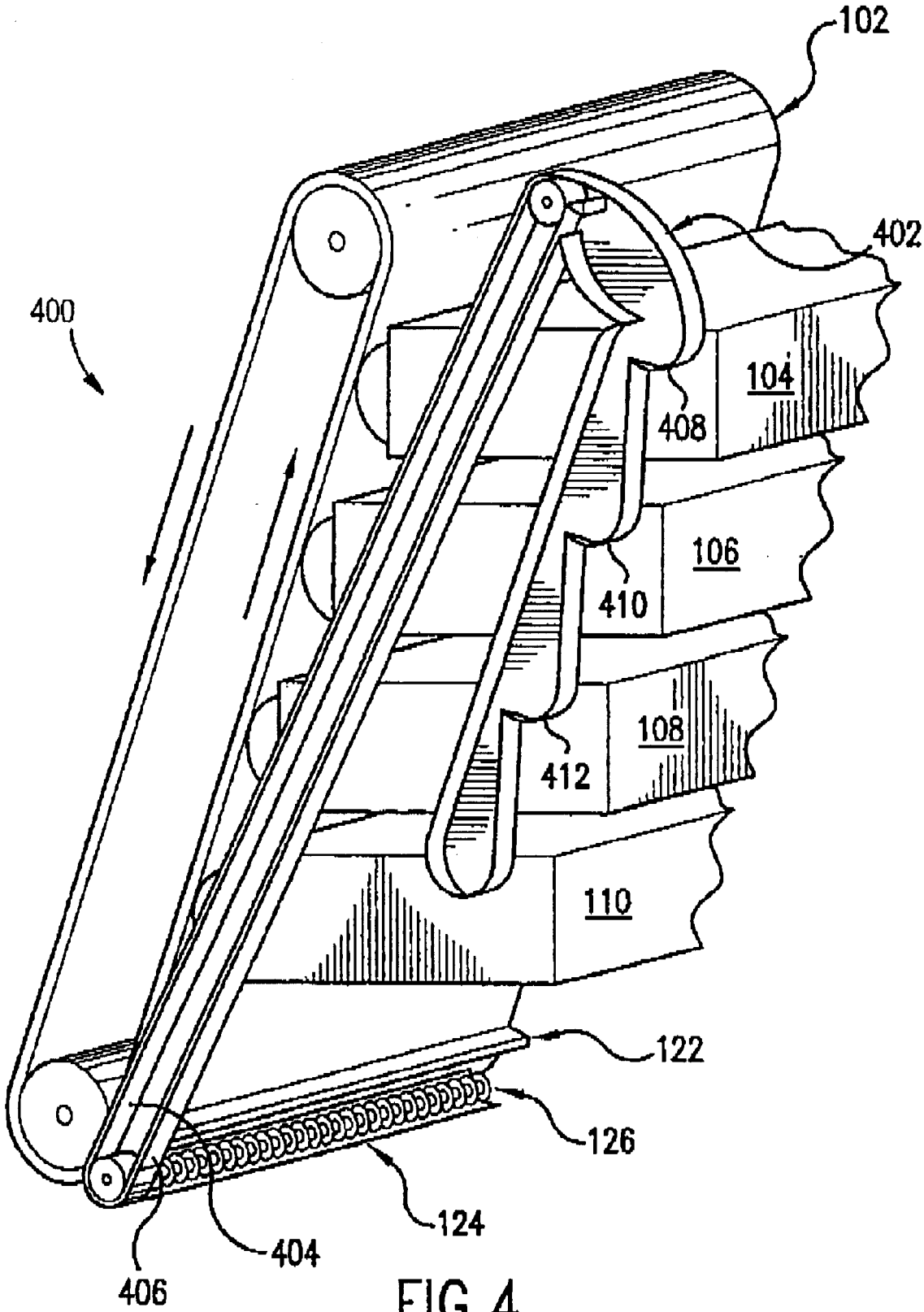
FIG. 4 is a simplified perspective view of an electrophotographic printing device according to another embodiment of the invention.

FIG. 4 is a simplified perspective view of an EP device 400 according to another embodiment of the invention. The EP device 400 of this embodiment is similar to the EP device 100 described hereinabove and thus only those features which are reasonably necessary for a complete understanding of this embodiment are described hereinbelow. Two differences from the EP device 100 are that the EP device 400 is configured in a relatively upright position relative to the EP device 100 and that a single chute 402 may be configured to convey residual toner to the toner cartridges 104, 106, 108, 110.

With regard to the chute 402, in operation, a conveyer belt 404 may be configured to transport the residual toner up a manifold 406 and deposit the residual toner at or near the top of the chute 402. As the residual toner falls down the chute 402, some portion of the residual toner may be deflected by an indent 408. The indent 408 is configured to direct the falling residual toner into the opening 220 (not shown in FIG. 4) in the toner cartridge 104. In an embodiment, the indent 408 may be configured such that a majority of the falling residual toner is directed through the opening 220 of the toner cartridge 104 and into the hopper 210 (not shown in FIG. 4). At such time that the hopper 210 becomes full, residual toner may block the opening 220 to the extent that little or no additional residual toner may enter the hopper 210.

Accordingly, residual toner may fill the indent 408 and allow substantially all of any additional residual toner to continue falling down the chute 402. As the residual toner continues to fall down the chute 402, some portion of the residual toner may be deflected by an indent 410. In a manner similar to the indent 408, the indent 410 is configured to direct at least some of the falling residual toner into the hopper 210 associated with the toner cartridge 106. Additionally, an indent 412 may function similarly to direct falling toner into the hopper 210 associated with the toner cartridge 108.

If the volume of residual toner exceeds the capacity of the hoppers 210 associated with the toner cartridges 104, 106, 108, residual toner may continue to fall down the chute 402 until it is directed into the hopper 210 associated with the toner cartridge 110. In this regard, the combined capacity of the hoppers associated with the toner cartridges 104–110 may be designed to hold at least as much residual toner as may reasonably be expected to be generated during the life of the toner cartridges 104, 106, 108, 110. The actual volume of the hopper 210 is determined based upon system design and the efficiency of toner transfer to the print medium.

In general, the volume of the hopper 210 may depend upon the following factors: system application, amount of toner per toner cartridge, transfer efficiency of toner from the ITB 102 to the print medium, optimization of the system, type of print job being performed, and the like. In one respect the volume of each hopper 210 may be designed to hold at least as much residual toner as may reasonably be expected to be generated based on the amount of toner originally placed in the respective toner cartridge 104, 106, 108, 110. Furthermore, in the event a user replaces a toner cartridge 104, 106, 108, 110 (e.g., toner is exhausted, toner cartridge malfunction, etc.), installation of a replacement for the toner cartridge 104, 106, 108, 110, may add to available hopper capacity.

Figure 5:
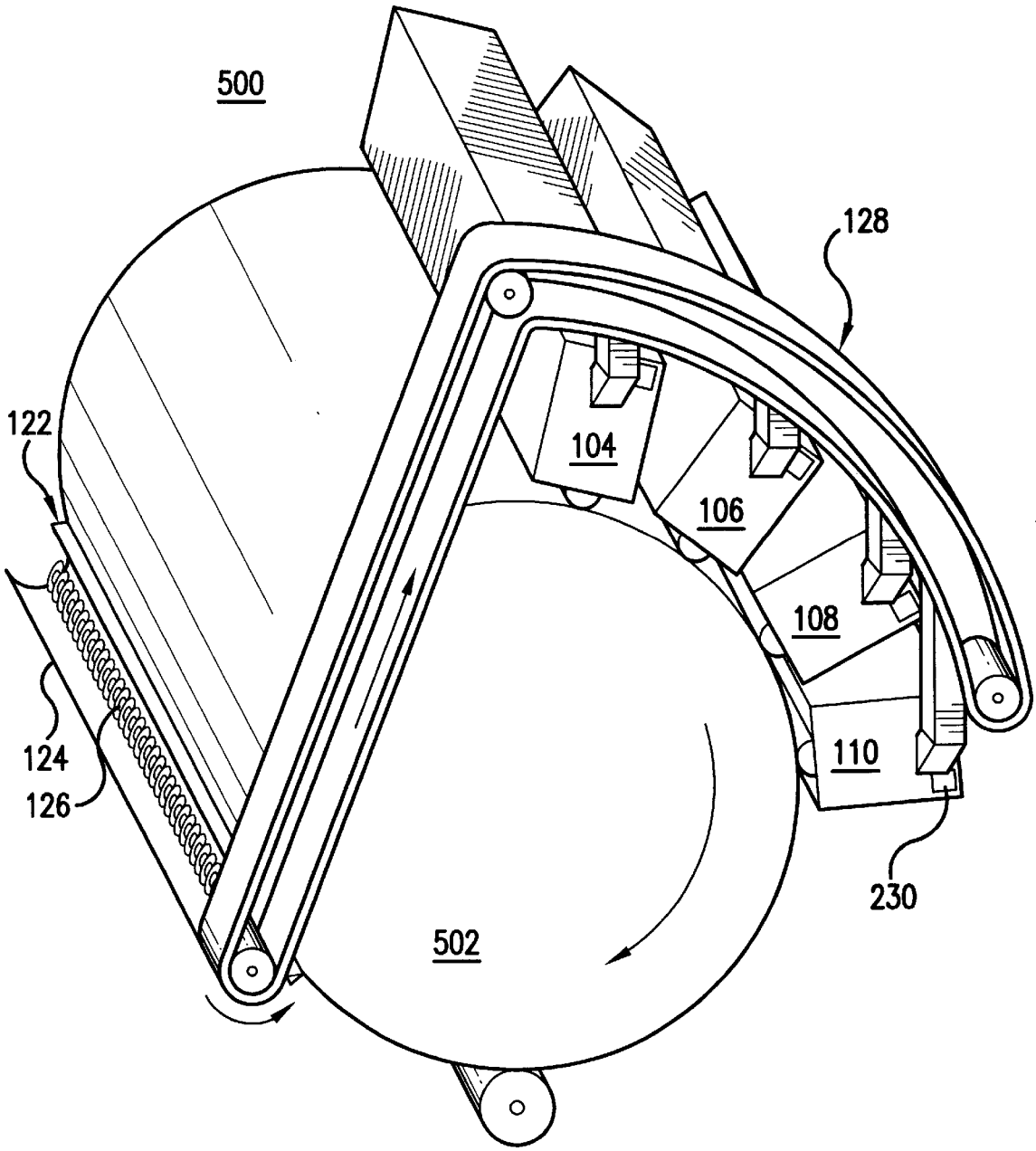
FIG. 5 is a simplified perspective view of an electrophotographic printing device according to yet another embodiment of the invention.

FIG. 5 is a simplified perspective view of an EP device 500 according to yet another embodiment of the invention. The EP device 500 of this embodiment is similar to the EP device 100 described hereinabove and thus only those features which are reasonably necessary for a complete understanding of this embodiment are described hereinbelow. One difference from the EP device 100 is that the EP device 500 is configured with an intermediate transfer drum ("ITD") 502. In a manner similar to the ITB 102, the ITD 510 may be utilized to collect toner from the one or more toner cartridges 104, 106, 108, 110 and transfer the toner to print media (not shown).

What has been described and illustrated herein are embodiments of the invention along with some of their variations. The terms, descriptions and figures used herein are set forth by way of illustration only and are not meant as limitations. Those skilled in the art will recognize that many variations are possible within the spirit and scope of the invention, which is intended to be defined by the following claims and their equivalents in which all terms are meant in their broadest reasonable sense unless otherwise indicated.

What is claimed is:

1. A component for an electrophotographic device, wherein said electrophotographic device includes an intermediate transfer device, said component comprising:

a hopper configured for association with a toner cartridge, said hopper being configured to store residual toner collected from said intermediate transfer device and wherein said hopper includes an opening configured to receive said residual toner.

2. The component according to claim 1, wherein said toner cartridge includes a receptacle configured to store residual toner collected from an optical photoreceptor.

3. The component according to claim 1, wherein said hopper is integrally formed with said toner cartridge.

4. The component according to claim 3, wherein a volume occupied by said hopper is substantially added to a volume of said toner cartridge.

5. The component according to claim 1, wherein said hopper is configured to be fastened to said toner cartridge.

6. The component according to claim 1, wherein said hopper includes a shutter having open and closed positions, said shutter in said open position being configured to allow entry of said residual toner into said opening of said hopper and said shutter in said closed position being configured to substantially seal said residual toner inside said hopper.

7. An electrophotographic device including an intermediate transfer device and a cleaning device configured to remove residual toner from said intermediate transfer device, said electrophotographic device comprising:

a toner cartridge having a hopper configured to store said residual toner removed from said intermediate transfer device;

a catch configured to collect said residual toner removed from said intermediate transfer device; and a residual toner conveyance device configured to transport said residual toner from said catch to said hopper to deposit said residual toner in said hopper.

8. The electrophotographic device according to claim 7, wherein said electrophotographic device includes a plurality of toner cartridges, each of said plurality of toner cartridges having a respective hopper.

9. The electrophotographic device according to claim 8, wherein said residual tonerconveyance device is configured to transport said residual toner from said catch to each of said respective hoppers.

10. The electrophotographic device according to claim 7, wherein said residual toner conveyance device comprises;

an auger configured to transport said residual toner to a first end of said catch;

a manifold configured to connect said first end of said catch to said hopper; and a belt configured to rotate within said manifold, said belt being operable to transport said residual toner from said first end of said catch to said hopper to deposit said residual toner in said hopper.

11. The electrophotographic device according to claim 7, wherein said intermediate transfer device includes an intermediate transfer belt.

12. The electrophotographic device according to claim 7, wherein said intermediate transfer device includes an intermediate transfer cylinder.

13. The electrophotographic device according to claim 7, wherein said toner cartridge includes a receptacle configured to store toner collected from an optical photoreceptor.

14. A method comprising steps of:

collecting residual toner from an intermediate transfer device of an electrophotographic device;

transporting said residual toner to a toner cartridge having a hopper; and depositing said residual toner in said hopper.

15. The method according to claim 14, wherein said electrophotographic device includes a plurality of toner cartridges, each of said plurality of toner cartridges having a respective hopper and said step of transporting further comprises:

transporting said residual toner to each of said plurality of hoppers.

16. The method according to claim 15, wherein said residual toner is substantially prevented from entering an essentially full hopper of said plurality of hoppers and at least some of said residual toner is allowed to enter a non-full hopper of said plurality of hoppers.

17. An electrophotographic device including an intermediate transfer device and a cleaning device configured to remove residual toner from said intermediate transfer device, said electrophotographic device comprising:

means for collecting said residual toner;

means for transporting said residual toner to a toner cartridge having a hopper, said hopper being configured to store said residual toner removed from said intermediate transfer device; and means for depositing said residual toner in said hopper.

18. The electrophotographic device according to claim 17, wherein said electrophotographic device includes a plurality of toner cartridges, each of said plurality of toner cartridges having a respective hopper.

19. The alectrophotographic device according to claim 18, wherein said means for transporting is configured for transporting said residual toner to each of said plurality of hoppers.

20. The electrophotographic device according to claim 19, wherein said means for transporting is further configured for transporting substantially all of said residual toner past an essentially full hopper of said plurality of hoppers, said means for transporting being further configured for transporting said residual toner to a non-full hopper of said plurality of hoppers.

* * * * *

UNITED STATES PATENT AND TRADEMARK OFFICE

CERTIFICATE OF CORRECTION

PATENT NO. : 6,711,366 B2
DATED : March 23, 2004
INVENTOR(S) : Beaufort

It is certified that error appears in the above-identified patent and that said Letters Patent is hereby corrected as shown below:

Column 1,
Line 12, delete “In” and insert therefor -- in --.

Column 2,
Line 42, delete “1336,” and insert therefor -- 136, --.
Line 63, delete “Is” and insert therefor -- is --.

Column 3,
Line 6, delete “Is” and insert thereof -- is --.

Signed and Sealed this

Twenty-fifth Day of January, 2005

JON W. DUDAS
*Director of the United States Patent and Trademark Office*